US005564460A

United States Patent [19]

Gronwick et al.

[11] Patent Number: 5,564,460

[45] Date of Patent: Oct. 15, 1996

[54] DOUBLE SEAL VACUUM BREAKER

[75] Inventors: Jerry P. Gronwick, Park Ridge; John R. Wilson, Naperville, both of Ill.

[73] Assignee: Sloan Valve Company, Franklin Park, Ill.

[21] Appl. No.: 505,061

[22] Filed: Jul. 21, 1995

[51] Int. Cl.[6] ..... E03C 1/10

[52] U.S. Cl. ..... 137/218; 137/853

[58] Field of Search ..... 137/218, 853

[56] References Cited

U.S. PATENT DOCUMENTS

| | | | |
|---|---|---|---|
| 2,092,757 | 9/1937 | Groeniger . | |
| 2,174,742 | 10/1939 | Groeniger . | |
| 2,270,737 | 1/1942 | Langdon . | |
| 2,292,373 | 8/1942 | Groeniger . | |
| 2,322,631 | 6/1943 | Groeniger . | |
| 2,372,726 | 4/1945 | Langdon . | |
| 2,382,427 | 8/1945 | Langdon . | |
| 2,449,573 | 9/1948 | White . | |
| 2,594,318 | 4/1952 | Langdon . | |
| 2,598,002 | 5/1952 | Langdon . | |
| 2,629,393 | 2/1953 | Langdon . | |
| 2,663,309 | 12/1953 | Filliung | 137/218 |
| 2,675,823 | 4/1954 | Langdon . | |
| 2,787,282 | 4/1957 | Langdon . | |
| 3,125,114 | 3/1964 | Langdon | 137/218 |
| 3,334,646 | 8/1967 | Billeter et al. | 137/218 |
| 3,797,515 | 3/1974 | Buhler . | |
| 3,965,922 | 6/1976 | McCornack . | |
| 4,646,775 | 3/1987 | Traylor . | |
| 5,060,687 | 10/1991 | Gayton . | |
| 5,454,396 | 10/1995 | Hochstrasser . | |

FOREIGN PATENT DOCUMENTS

| | | |
|---|---|---|
| 1091498 | 10/1960 | Germany . |
| 955471 | 4/1964 | United Kingdom . |

*Primary Examiner*—Gerald A. Michalsky
*Attorney, Agent, or Firm*—Dorn, McEachran, Jambor & Keating

[57] ABSTRACT

A vacuum breaker assembly includes an outlet tube having circumferential air ports and a vacuum breaker sleeve formed of a flexible elastomeric material positioned within the outlet tube. Conventionally, a stiffening funnel will be positioned within the vacuum breaker sleeve. The elastomeric sleeve has an inlet end and an outlet end and is located within the outlet tube adjacent the spaced air ports. The vacuum breaker sleeve has lip seals in the interior intermediate the inlet and outlet ends, with the lip seals opening in response to water pressure at the inlet end to permit water to pass through the vacuum breaker assembly. There are peripherally spaced projections on the exterior of the vacuum breaker sleeve adjacent the outlet end to space the exterior of the sleeve from the outlet tube. There is a tapered lip seal extending axially from the outlet end of the vacuum breaker sleeve, with the lip seal being downstream of the spacing projections. The tapered lip seal is outwardly movable into closing contact with the outlet tube in response to back pressure downstream of the vacuum breaker assembly, such closing contact preventing water flow through the air ports of the outlet tube.

3 Claims, 1 Drawing Sheet

Fig.1.
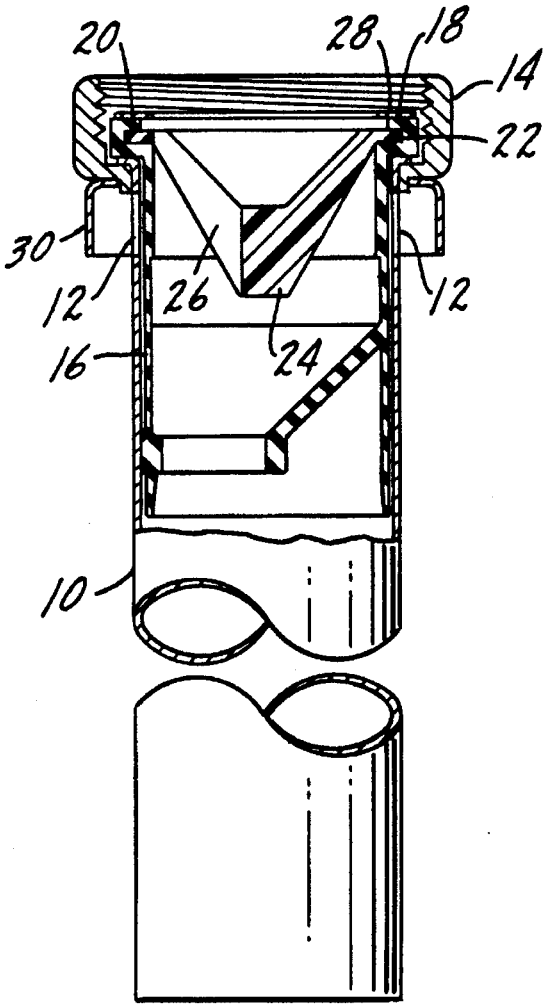
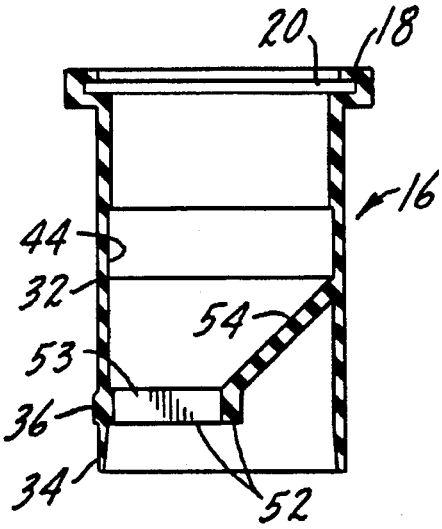
Fig.3.
Fig.2.
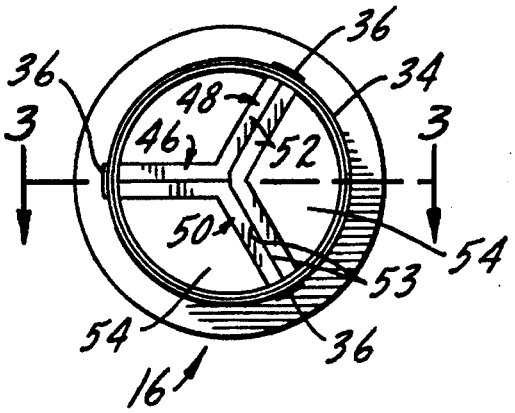
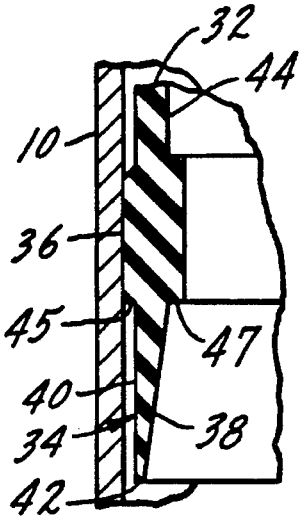
Fig.4.

DOUBLE SEAL VACUUM BREAKER

THE FIELD OF THE INVENTION

The present invention relates to vacuum breakers of the type customarily found in toilet room installations between a flush valve and the toilet device whether it be a water closet or a urinal. The function of the vacuum breaker is to prevent back siphonage from the toilet device back into the potable water supply that is feeding the flush valve. U.S. Pat. No. 3,334,646, owned by Sloan Valve Company, the assignee of the present application, shows a type of vacuum breaker assembly which has long been used in this art.

A problem has arisen with vacuum breakers of the type shown in the '646 patent in that with the requirement for gals. of water per flush for water closets and 1.0 gals. per flush for urinals, the restrictions in the plumbing fixtures used to increase water flow velocity, at times create very dramatic and sudden increases in back pressure on the vacuum breaker assembly. As a result of these dramatic increases in back pressure, often referred to as spikes, conventional vacuum breakers will not close off against the air vent slots in the outlet tube rapidly enough to prevent water being expelled from these slots. Users of such toilet room devices consider this water to be leakage.

The present invention overcomes the above-described problem by having a low energy large surface area lip seal incorporated at the downstream end of the vacuum breaker sleeve. Thus, when there is a spike of back pressure across the vacuum breaker, the low energy large surface area lip seal reacts instantaneously, causing the vacuum breaker sleeve to close peripherally against the interior of the outlet tube, preventing leakage through the outlet tube air ports.

SUMMARY OF THE INVENTION

The present invention relates to vacuum breakers of the type customarily found in toilet rooms to prevent back siphonage from a toilet device such as a water closet or urinal back into the potable water supply. A primary purpose of the invention is an improved vacuum breaker sleeve which has a lip seal capable of rapidly closing against the vacuum breaker outlet tube when there is a sudden and dramatic increase in back pressure at the vacuum breaker assembly.

Another purpose is a vacuum breaker assembly and sleeve as described in which there is a gradually tapering lip seal at the downstream or outlet end of the vacuum breaker sleeve which is capable of rapidly reacting to a dramatic change in back pressure at the vacuum breaker assembly.

Another purpose is a vacuum breaker sleeve as described which functions in the normal manner to prevent back siphonage and which, through the use of the described lip seal, reacts instantaneously to back pressure to prevent leakage through the outlet tube air ports.

Other purposes will appear in the ensuing specification, drawings and claims.

BRIEF DESCRIPTION OF THE DRAWINGS

The invention is illustrated diagrammatically in the following drawings wherein:

FIG. 1 is a side view of a vacuum breaker assembly of the type disclosed herein;

FIG. 2 is an end view of the vacuum breaker sleeve;

FIG. 3 is a section along plane 3—3 of FIG. 2; and

FIG. 4 is an enlarged section illustrating the lip seal at the downstream end of the vacuum breaker sleeve of FIGS. 2 and 3.

DESCRIPTION OF THE PREFERRED EMBODIMENT

U.S. Pat. No. 3,334,646, owned by Sloan Valve Company, the assignee of the present application, discloses a vacuum breaker assembly similar to that set forth herein. The disclosure of the '646 patent is incorporated by reference herein as providing a detailed description of the function and operation of vacuum breakers of this type. In summary, such vacuum breakers are customarily connected in toilet rooms between the flush valve which provides water for flushing a toilet device, and the toilet device itself. The toilet device may be a water closet or it may be a urinal.

Present-day plumbing codes often provide a limit of 1.6 gals. per flush for water closets and 1.0 gals. per flush for urinals. As a result of the restrictions in the plumbing fixtures, used to increase water flow velocity, there are occasional dramatic increases in back pressure at the vacuum breaker assembly. Such back pressure increases or spikes as they are termed in the art occur so rapidly that the vacuum breaker sleeve does not have time to close against the interior wall of the outlet tube before there is leakage through the air ports of the outlet tube. The present invention is specifically directed to overcoming this problem and does so by providing a thin flexible lip seal at the downstream end of the vacuum breaker sleeve. This lip seal, having a low energy large surface area, reacts essentially instantaneously to a spike of back pressure, causing the vacuum breaker lip seal to close against the interior of the outlet tube, thus preventing leakage. In other respects, the vacuum breaker sleeve functions in the manner as described in the '646 patent.

In the drawings, the vacuum breaker assembly includes an outlet tube 10 having peripherally spaced air openings 12. A coupling nut 14 is used to attach the vacuum breaker assembly to the outlet end of a flush valve or flushometer as this device is presently termed in the plumbing trade. The downstream end of the outlet tube 10 will be connected to the inlet side of a toilet device such as a water closet or urinal.

Positioned inside of the outlet tube 10 is a vacuum breaker sleeve 16 which is suitably formed of a rubberlike or flexible elastomeric material. The upstream end of the sleeve 16 includes a flange 18 having a recess 20 which supports the outwardly extending flange 22 of an insert or stiffening funnel 24. The funnel 24, which is conventional in the art, includes a plurality of openings 26 for the passage of water. A slip ring 28 is seated on top of flange 18 and forms a portion of the connection between the coupling nut 14 and the outlet end of the flush valve. There is a hood 30 which may be crimped onto the lower end of the coupling nut 14 and is used as a shield for the air openings 12. The hood is spaced from the air openings so that they may perform their intended function of admitting air at atmospheric pressure into the interior of the vacuum breaker assembly to prevent back siphonage.

The vacuum breaker flexible sleeve 16 is illustrated in detail in FIGS. 2 through 4. The sleeve includes a body 32 which extends from the flange 18. The body is cylindrical and terminates at its lower end in a low energy large surface area lip seal 34. There are a plurality, in this case three, generally equally spaced projections 36 on the exterior of the sleeve, with these projections being adjacent the downstream end of the sleeve. They projections are effective to align, locate and space the exterior wall of body 32 of the vacuum breaker sleeve from the interior of the outlet tube so that air from the inlets 12 may enter the space beneath the vacuum breaker sleeve to prevent back siphonage.

The lip seal 34, illustrated in detail in FIG. 4, extends from the downstream end of the body 32 directly adjacent the projections 36 and includes a gradually outwardly tapering inner surface 38 and a coaxial or cylindrical outer surface 40, with these two surfaces terminating in the end 42 of the lip seal. The outer surface 40 of the lip seal 34 is generally continuous with the outer cylindrical surface of the body 32 of the vacuum breaker sleeve. The tapered interior surface 38, at its upper end, is an extension of the interior surface 44 of the sleeve body 32. The shoulders 45 and 47 illustrated in FIG. 4 are formed between the lip seal 34 and the projections 36 and the interior valve which controls the flow of water through the flexible sleeve as will be described. The large surface area lip seal 34, however, is basically a continuation of the interior and exterior surfaces of the sleeve body 32.

As illustrated particularly in FIG. 2, the interior of the sleeve has three lip seals indicated at 46, 48 and 50. Each of these lip seals, at the lower exterior thereof, has ribs 52 which are slightly thicker than other portions of the lip seals, with the ribs defining between them a slit 53 which can open to permit the passage of water through the vacuum breaker assembly. Each of the ribs 52, at their upper ends, join with walls 54 with the upper end of each of the walls 54 being integral with the vacuum breaker assembly body 32. There are two walls 53 between each adjacent pair of ribs 52. Although the lip seals which control the flow of water through the flush valve as described above are three in number, it is also possible to have more than three lip seals or a vacuum breaker sleeve with only one such lip seal which would be more of a single duckbill design rather than the trilobular lip seal shown and described herein.

In use, normally when the flush valve is operated the flow of water into the vacuum breaker assembly will pass through the stiffening funnel 24, with water pressure forcing the lip seals 46, 48, and 50 to spread apart, permitting water to flow to the toilet device connected at the outlet end of the vacuum breaker assembly. In the event there is a negative pressure at the water supply, air will flow in through the air openings 12, causing the walls of the vacuum breaker sleeve to collapse upon the support, preventing the passage of water from the downstream toilet device into the potable water supply. The lip seals 46, 48, and 50 assist in preventing such back siphonage.

In the event there is a dramatic increase in back pressure because of a toilet device restriction as described, the downstream lip seal 34, being thin and directly adjacent the wall of the outlet tube, will rapidly move outwardly against the wall to seal the air openings 12.

The present vacuum breaker assembly responds to all types of pressure differentials which may at times be created within the described plumbing system. Back siphonage is prevented, as is the outward flow of water through the air ports.

Prior to the creation of the vacuum breaker assembly with the described lip seal at the downstream or outlet end, one of the attempts to solve the problem of leakage through the air opening was to reduce the length of the lip seals 46, 48, and 50 to maintain a higher pressure in the upstream cavity of the vacuum breaker sleeve. This minimized water leakage at the air openings, but decreased the flow rate of water through the vacuum breaker assembly, especially at low line pressure conditions. With the use of the lip seal 34 as described herein, the length of the lip seal openings can actually be increased beyond what was known in the art which results in a substantially freer flow of water through the vacuum breaker assembly.

Whereas the preferred form of the invention has been shown and described herein, it should be realized that there may be many modifications, substitutions and alterations thereto.

The embodiments of the invention in which an exclusive property or privilege is claimed are defined as follows:

1. A vacuum breaker assembly including an outlet tube having circumferentially spaced air ports therein, a vacuum breaker sleeve formed of a flexible elastomeric material positioned within said outlet tube, said vacuum breaker sleeve having an inlet end and an outlet end and being located within said outlet tube adjacent said spaced air ports, said vacuum breaker sleeve having lip seal means in the interior thereof intermediate said inlet end and said outlet end, said vacuum breaker lip seal means including a plurality of equally spaced lip seals, each of which extends from the axis of said vacuum breaker sleeve toward the exterior of said sleeve, with said lip seal means opening in response to water pressure at the inlet end, spacing means including a plurality of uniformly spaced outwardly extending projections on the exterior of said vacuum breaker sleeve adjacent the outlet end to space the exterior of said vacuum breaker sleeve from said outlet tube, and a peripheral low energy large surface area lip seal extending axially from the outlet end of said vacuum breaker sleeve, the interior of said axially extending lip seal tapering from an area adjacent said outwardly extending projections to the end of said axially extending lip seal, with the exterior surface of said lip seal being coaxial with the exterior of said vacuum breaker sleeve, said lip seal being downstream of said spacing means, and being outwardly movable into closing contact with the outlet tube in response to back pressure downstream of the vacuum breaker assembly, such closing contact preventing water flow through said air ports.

2. The vacuum breaker assembly of claim 1 wherein there is a stiffening funnel positioned within said vacuum breaker sleeve and attached to the inlet and thereof, said stiffening funnel having openings for the passage of water.

3. A vacuum breaker sleeve for use in a tubular casing having a plurality of circumferentially disposed air ports and being connected between a flush valve and a toilet device, said sleeve being formed of a flexible elastomeric material and having an inlet end and an outlet end and when located within a tubular casing is generally adjacent the spaced air ports thereof, said vacuum breaker sleeve having a plurality of equally spaced lip seals therein intermediate the inlet end and the outlet end, each of said plurality of lip seals extending from the axis of said vacuum breaker sleeve toward the exterior of said sleeve, with said lip seal means opening in response to water pressure at the inlet end, a plurality of uniformly spaced outwardly extending projections functioning as spacing means on the exterior of said vacuum breaker sleeve adjacent the outlet end to space the exterior of said vacuum breaker sleeve from the outlet tube, and a peripheral low energy large surface area lip seal extending axially from the outlet end of said vacuum breaker sleeve, the interior of said axially extending lip seal tapering from the area adjacent said uniformly spaced projections to the end of said axially extending lip seal, with the exterior surface being coaxial with the exterior of said vacuum breaker sleeve, said lip seal being downstream of said spacing means and being outwardly movable into closing contact with the outlet tube in response to back pressure downstream of the vacuum breaker sleeve, said closing contact preventing water flow through the outlet tube air ports.

* * * * *